US011639284B1

(12) United States Patent
Becker

(10) Patent No.: US 11,639,284 B1
(45) Date of Patent: May 2, 2023

(54) WEDGE BRAKE ELEVATOR SAFETY SYSTEM

(71) Applicant: George F. Becker, Fort Myers, FL (US)

(72) Inventor: George F. Becker, Fort Myers, FL (US)

( * ) Notice: Subject to any disclaimer, the term of this patent is extended or adjusted under 35 U.S.C. 154(b) by 0 days.

(21) Appl. No.: 17/545,136

(22) Filed: Dec. 8, 2021

(51) Int. Cl.
*B66B 5/22* (2006.01)
*B66B 7/10* (2006.01)
*B66B 5/24* (2006.01)

(52) U.S. Cl.
CPC ..... *B66B 5/22* (2013.01); *B66B 5/24* (2013.01); *B66B 7/10* (2013.01)

(58) Field of Classification Search
CPC .. B66B 5/24; B66B 5/22; B66B 17/34; B66B 11/0293; B66B 5/16; B66B 9/16; B66F 7/02
See application file for complete search history.

(56) References Cited

U.S. PATENT DOCUMENTS

| | | | | |
|---|---|---|---|---|
| 3,215,231 | A | 11/1965 | Lodige | |
| 5,096,020 | A | 3/1992 | Korhonen | |
| 5,230,406 | A | 7/1993 | Poon | |
| 5,310,022 | A | 5/1994 | Sheridan et al. | |
| 5,645,142 | A | 7/1997 | Kraemer et al. | |
| 7,036,638 | B2 | 5/2006 | Simmonds et al. | |
| 8,020,671 | B2 | 9/2011 | Kocher et al. | |
| 8,863,909 | B2 | 10/2014 | Dudde et al. | |
| 9,663,327 | B2 | 5/2017 | Terry et al. | |
| 10,407,278 | B2 | 9/2019 | Zhang et al. | |
| 2008/0296098 | A1 | 12/2008 | Sato et al. | |
| 2015/0122592 | A1* | 5/2015 | Zhu | B66B 5/24 188/65.1 |

FOREIGN PATENT DOCUMENTS

| | | | | |
|---|---|---|---|---|
| CN | 105883529 A | * | 8/2016 | B66B 5/22 |
| CN | 109132777 A | * | 1/2019 | |
| CN | 109132926 A | * | 1/2019 | B66F 7/02 |
| CN | 111942991 A | * | 11/2020 | |
| KR | 102393170 B1 | * | 5/2022 | |
| WO | WO 02/057170 | | 7/2002 | |

* cited by examiner

*Primary Examiner* — Diem M Tran
(74) *Attorney, Agent, or Firm* — Edward M. Livingston, Esq.; Livingston Law, P.A.

(57) ABSTRACT

A vertical lift system having a safety brake assembly (10) employing a pair of brakes attached to cables running vertically on each side of a guiderail (1). Each brake has a series of wedges (13, 14, and 15), including a braking wedge (14) that presses against the guiderail to brake downward motion of an elevator or lift basket upon an interruption in cable tension. A cable tension adjustment mechanism (3, 4 and 6) to equalize tension in the cables is also incorporated into the safety brake assembly. An electrical sensor (18) is also provided to disrupt power to the lift system upon slackening of a cable.

8 Claims, 3 Drawing Sheets

DETAIL A

DETAIL B

WEDGE BRAKE ELEVATOR SAFETY SYSTEM

BACKGROUND OF THE INVENTION

This invention relates to elevators and vertical lift systems, more particularly an elevator employing a specific cable arrangement and brake device which work together to stop a downward travel of an elevator car in the event of a slack cable.

Conventional elevators and lifts have suspension means consisting of cables and are required to have a brake, otherwise known as an elevator safety brake, or slack rope brake, which grips or latches on to some surface if any part of the suspension means fails. A total failure of the suspension means can send an elevator car into free fall as the cables would no longer have the weight of the car applying tension. For this reason, it is common for an elevator safety device to act upon the slackening of a cable. Such brakes typically grip the elevator guide rail or a strip attached to the elevator guide rail. Elevator guide rails are most commonly a T-shaped steel form, with only a few sizes being standardized or typical to the industry. For this reason, elevator safety devices currently produced are designed to act on this specific shape with little or no alternatives for using other shapes as guiderails. T-shaped guide rails are conducive to elevators which are in an elevator shaft, and are hung in a balanced symmetrical way by the suspension means. Such rails act as a guide only and are not load bearing.

It has become increasingly common for elevators to be built and installed adjacent to a structure as opposed to in a shaft or hoist way, particularly when the building was not initially designed to have an elevator. With these type installations it is advantageous to use shapes for guide rails that act as both a guide and a load bearing member. I-beams are commonly used since the guide rollers can be arranged at the front and back of the front flange of the beam, thus the load of the elevator car can be cantilevered from them. This trend has necessitated the development of a braking system for elevators that ride on such beams and also other structural shapes, such as a C-channel.

It is considered unsafe for an elevator brake to act on only one surface of the member it engages. A brake designed in such a way would tend to distort the member it is acting upon. Therefore, it is a safety requirement for elevator brakes to clamp the member it acts upon on both front and back and between two surfaces of the brake, respectively. Clamping two sides of a stationary member means at least two parts of the brake device must move and interact with each other in some way. Accomplishing such with a T-shaped guide rail and a single cable acting upon the brake device is simple. The narrow nature of the T-rail lends itself to simply having a pair of brake shoes extend to either side of the leg, and any linkage or mechanism joining the two brake shoes so they close in unison.

However, accomplishing the latter when utilizing shapes with multiple intersecting planes and surfaces, such as I-beams, for guide rails is more challenging. To similarly use a single slack cable to actuate a brake that clamps both sides of the web of an I-beam, the brake shoes would need to be linked by a mechanism that wraps around the flange of the beam. Thus, the simple mechanism described above for the T-rail brake that joins the two brake shoes now has corners so it needs to traverse around a considerable distance to link the first brake shoe to the second. Such a mechanism is complicated and expensive to build.

Furthermore, many installations of such elevators without a conventional shaft are done outside, or in other harsh environments. For this reason, maintaining simplicity is advantageous since complicated mechanisms tend to be susceptible to corrosion and contamination.

In addition, elevators that are suspended by cables need provisions to halt electrical operation upon slackening of a cable. As the present invention is actuated upon cable slackening it is conducive to incorporate such a sensor into the construction of the device, particularly by way of proximity sensor.

Thus, a need exists for an elevator braking system for use with an I-beam and other shapes of guiderails that solve the above problems.

The prior patented art includes the following references, but none disclose a device like the present invention.

| Patent/App. No. | Inventor | Issue/Pub. Date |
|---|---|---|
| 1. 3,215,231 | Lodige | Nov. 02, 1965 |
| 2. 5,096,020 | Korhonen | Mar. 17, 1992 |
| 3. 5,230,406 | Poon | Jul. 27, 1993 |
| 4. 5,310,022 | Sheridan et al. | May 10, 1994 |
| 5. 5,645,142 | Kraemer et al. | Jul. 08, 1997 |
| 6. WO 02/057170 | Walker | Jul. 25, 2002 |
| 7. 7,036,638 | Simmonds et al. | May 02, 2006 |
| 8. 2008/0296098 | Sato et al. | Dec. 04, 2008 |
| 9. 8,020,671 | Kocher et al. | Sep. 20, 2011 |
| 10. 8,863,909 | Dudde et al. | Oct. 21, 2014 |
| 11. 9,663,327 | Terry et al. | May 30, 2017 |
| 12. 10,407,278 | Zhang et al. | Sep. 10, 2019 |

SUMMARY OF THE INVENTION

The primary object of the present invention is to provide an elevator braking system device that can be used with guiderails having a variety of metal shapes.

Another object of the present invention is to provide such an elevator braking system device that simplifies the construction of previously-known elevator slack cable brakes.

A further object of the present invention is to provide such an elevator braking system device that simplifies the construction of previously-known elevator slack cable brakes.

An additional object of the present invention is to provide an elevator braking system that can sense slackening of a cable to stop the operation of the elevator.

The present invention fulfills the above and other objects in an elevator braking by positioning lifting cables at each of the two sides of the guide rail for a wedge brake to act upon with each cable acting upon its respective half of the brake mechanism. Thereby, the additional cable takes the place of any linkage or mechanism that would typically join the pair of brake shoes. If one of the two cables fails its respective brake assembly has adequate stopping force to stall the downward travel to a degree that the cable on the opposite side goes slack as well, and likewise its respective brake engages. While the engagement of the two brake assemblies might not be simultaneous in the event of a single cable failure, the second brake assembly does engage before any significant deflection of the guiderail occurs due to engagement of the first.

When dealing with multiple cables it is necessary to have some means to equalize cable tension and thus the present invention also integrates a cable tensioning method into the brake assembly by having provisions for locking and unlocking the wedge brake the cable directly acts upon from the eye bolt or similar anchor it attaches to. Upon initial installation the cable tension can be adjusted with the wedge and cable attachment unlocked from each other. Then when equal cable tension is attained, by adjustment nut or similar item, the two components can be locked together by means of a set screw or similar item so that any interruption in cable tension would result in a downward movement of the wedge and thus engagement between the brake shoe and guiderail.

In addition to the above features, an electrical sensor or slack cable switch is provided to disrupt power to the driving means of an elevator upon sensing slackening of a cable.

The above and other objects, features and advantages of the present invention should become even more readily apparent to those skilled in the art upon a reading of the following detailed description in conjunction with the drawings wherein there is shown and described illustrative embodiments of the invention.

DESCRIPTION OF THE DRAWINGS

In the following detailed description, reference will be made to the attached drawings in which.

DESCRIPTION OF THE PREFERRED EMBODIMENTS

Figure 2:
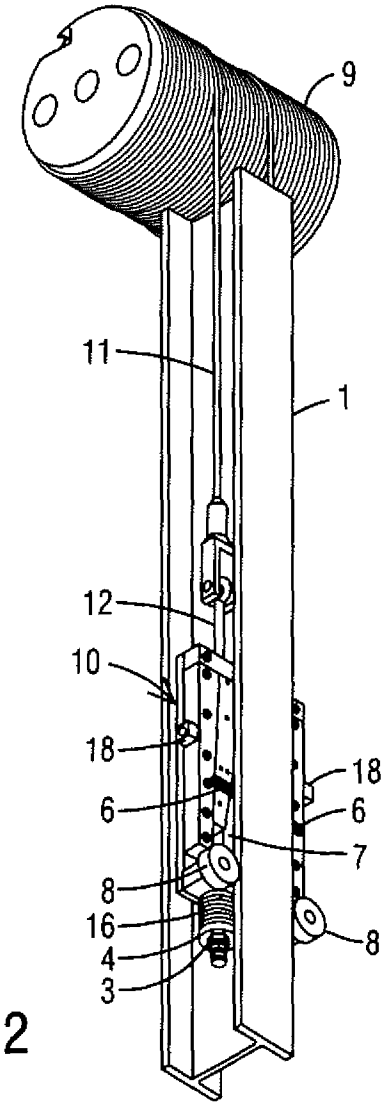
FIG. 2 is a front perspective view the elevator brake assembly of the present invention showing the cable arrangement and winding drum with I-beam guiderail.

For purposes of describing the preferred embodiment, the terminology used in reference to the numbered components in the drawings is as follows:

1. I-beam guide rail
2. top guide wheels
3. cable tension adjustment nut
4. spring stops
5. set screws
6. retracting springs
7. brake surfaces
8. bottom guide wheels
9. cable drum
10. elevator brake assembly, generally
11. cable
12. eye bolts
13. actuating wedges
14. braking wedges
15. stationary wedges
16. compression springs
17. rear wedge plates
18. electrical sensor/slack cable switch
19. fasteners for wedge plates
20. electrical power wire to 18

Figure 1:
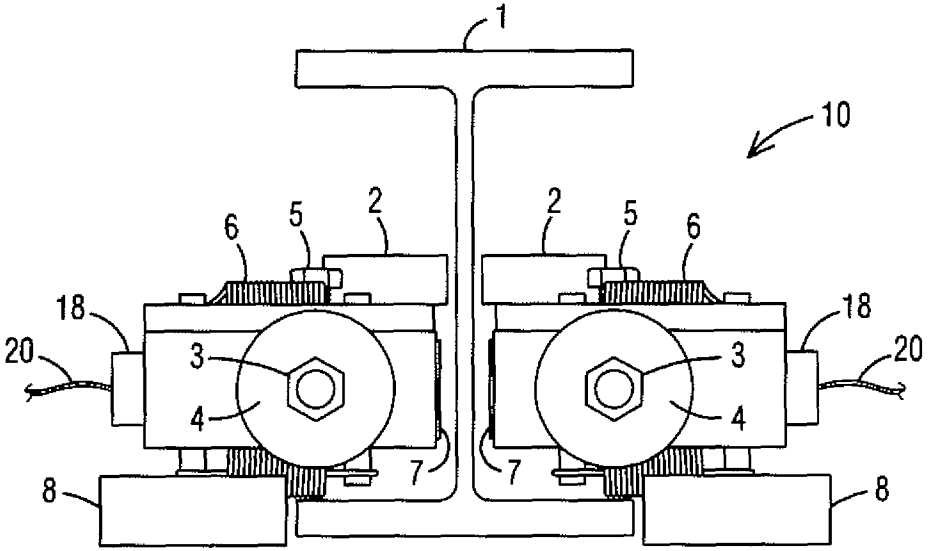
FIG. 1 is a bottom end view of an elevator brake assembly of the present invention with an I-beam being utilized as a guiderail.

Referring to the drawing figures, FIG. 1 illustrates a bottom end view of the elevator brake assembly 10 of the present invention consisting of dual brake assemblies running vertically within an I-beam 1. Each assembly has lower guide wheels 8 which abuts and runs along a front of the I-beam 1 and a top or upper guide wheel 2 which runs along a center rail of the I-beam 1. Each assembly has a brake surface 7 for gripping against the I-beam 1 in case of a cable malfunction to stop an elevator car from falling. Retracting springs 6 maintain the brake surfaces 7 away from the I-beam 1 during normal operation of an elevator. Rotatable cable tension adjustment nuts 3 and spring stops 4 are provided to adjust the cable tension exerted by compression springs 16 (shown in FIGS. 2-6). An electrical sensor with slack cable switch 18 connected to the electrical wire 20 that powers the elevator is provided to detect cable slackening and deactivate electrical power to the elevator upon such an occurrence.

FIG. 2 illustrates a front perspective view of an elevator brake assembly 10 of the present invention as it would appear in operation without an elevator car attached thereto. The brake assemblies 10 are attached within opposite cavities of the I-beam 1 by eyebolts 12 to a cable 11 from a cable drum 9. Each brake assembly 10 is guided along the I-beam 1 by lower guide wheels 8 and top guide wheels 2 (not shown). Other components of the brake assembly 10, such as brake surface 7, compression spring 16, spring stop 4 and cable tensions adjustment nut 3 are also shown. Also, an electrical sensor with slack cable switch 18 connected to the electrical wire 20 that powers the elevator is provided to detect cable slackening and deactivate electrical power to the elevator upon such an occurrence.

Figure 3:
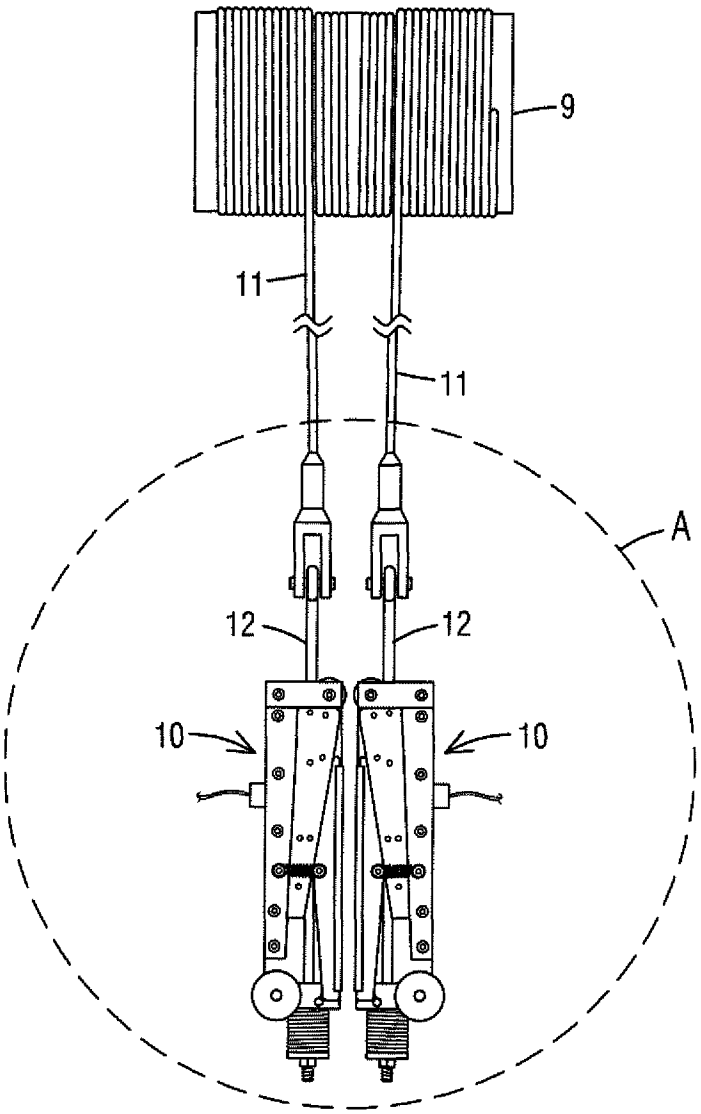
FIG. 3 is a front view of the elevator brake assembly of the present invention and cable attachment assembly of FIG. 2 without the i-beam guiderail.

FIG. 3 illustrates a front view of the elevator brake assembly 10 of the present invention without an I-beam guide rail. As previously described the dual brake assemblies 10 are suspended from the cable drum by cable 11 and eye bolt brackets 12. Each brake assembly 10 as shown here and in the enlarged view of FIG. 4 consist of a top plate 18 attached to which are three vertical wedges: an outer stationary wedge 15, a middle actuating wedge 13 and an inner braking wedge 14 with braking surface 7. The braking wedge 7 is attached to the stationary wedge 15 with the actuating wedge 13 sandwiched in between by a retracting spring 6. Also, an electrical sensor with slack cable switch 18 connected to the electrical wire 20 that powers the elevator is provided to detect cable slackening and deactivate electrical power to the elevator upon such an occurrence.

Figure 4:
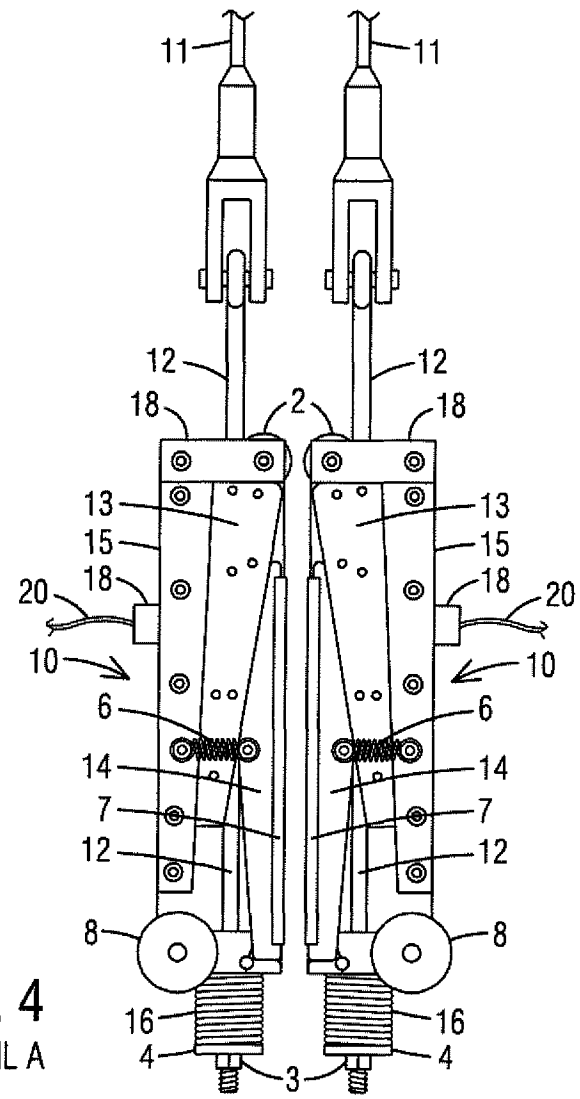
FIG. 4 is an enlarged sectional view along section A of FIG. 3 of the elevator brake assembly of the present invention.
Figure 6:
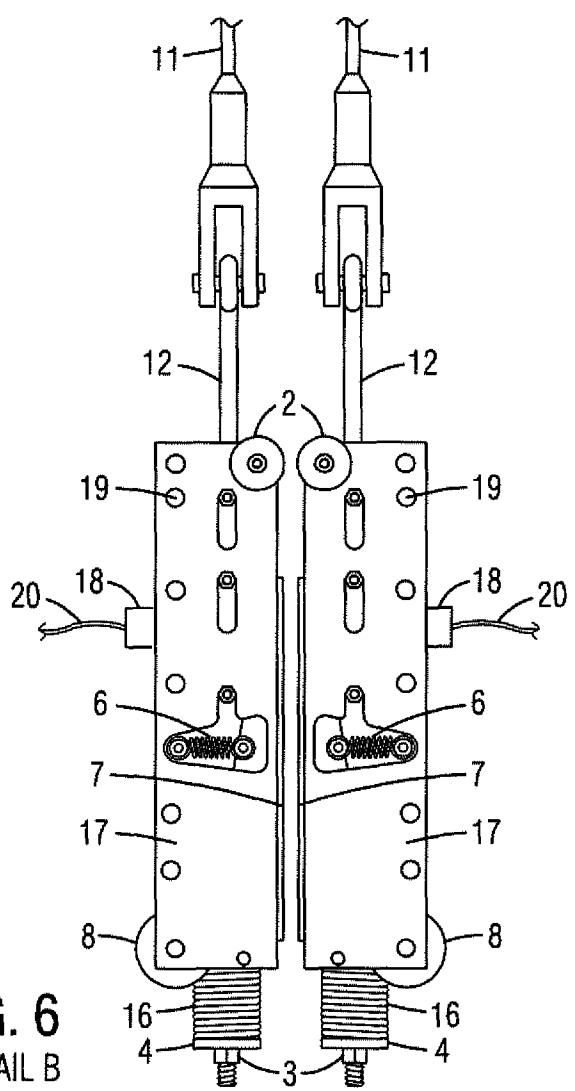
FIG. 6 is an enlarged sectional view along section B of FIG. 5 of the elevator brake assembly of the present invention.
Figure 5:
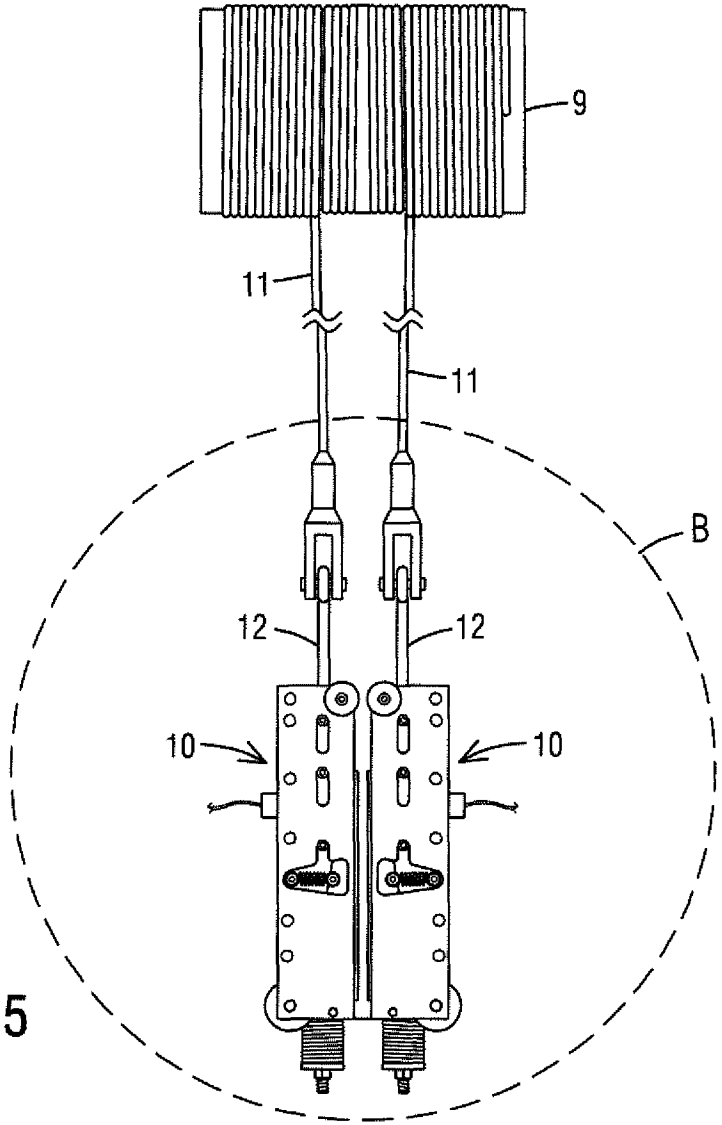
FIG. 5 is a rear view of the elevator brake assembly of the present invention and cable attachment assembly of FIG. 2 without the I-beam guiderail.

FIGS. 5 and 6 illustrate a rear view of the elevator brake assembly 10 shown in FIGS. 3 and 4. The only components shown here which have not been previously illustrated and described are the rear wedge plate 17 and a plurality of fasteners 19, such as rivets or similar items, which hold together the wedges of the elevator brake assembly 10. Also, an electrical sensor with slack cable switch 18 connected to the electrical wire 20 that powers the elevator is provided to detect cable slackening and deactivate electrical power to the elevator upon such an occurrence.

It is to be understood that while preferred embodiments of the invention have been described, it is not to be limited to the specific form or arrangement of parts herein described and shown. It will be apparent to those skilled in the art that various changes may be made without departing from the scope of the invention and the invention is not to be considered limited to what is shown and described in the specification and/or drawings.

Having thus described my invention, I claim:

1. A vertical lift device with brake assembly comprising:

a guiderail having at least two opposite sides;

a cable drum for holding a predetermined length of cable mounted over said guiderail, having a minimum of two cables suspended therefrom;

at least one cable positioned on opposite sides of the guiderail; and a cable brake attached to an end of each cable to clamp the guiderail in the event of cable failure.

2. The vertical lift device with brake assembly of claim 1 wherein each cable brake comprises:

a plurality of wedges comprising an outer stationary wedge, a middle actuating wedge and an inner braking wedge with a braking surface for grippingly engaging a side of the guiderail when the cable brake moves downward along the guiderail.

3. The vertical lift device with brake assembly of claim 2 wherein the plurality of wedges of each cable brake are connected laterally by a retracting spring.

4. The vertical lift device with cable brake assembly of claim 1 wherein each cable brake further comprises:

at least one guide wheel to facilitate movement of the brake up and down a side of the guiderail.

5. The vertical lift device with cable brake assembly of claim 1 wherein each cable is attached to each brake by an eye bolt and shank.

6. The vertical lift device with brake assembly of claim 1 wherein the guiderail is an I-beam.

7. The vertical lift device with brake assembly of claim 1 further comprising means for adjusting tensions in the at least one cable, said means comprising:

a cable tension adjustment nut rotatably attached to an end of each cable below each cable brake, said cable tension adjustment nut being rotated against a stop and compression spring to adjust and equalize the tension in each cable.

8. The vertical lift device with brake assembly of claim 1 further comprising an electrical sensor that disrupts electrical power to the lift device upon slackening of a cable.

* * * * *